US009042569B2

(12) United States Patent
Sakamoto et al.

(10) Patent No.: US 9,042,569 B2
(45) Date of Patent: May 26, 2015

(54) ACTIVE NOISE CONTROL DEVICE

(75) Inventors: Kosuke Sakamoto, Utsunomiya (JP); Toshio Inoue, Tochigi-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 426 days.

(21) Appl. No.: 13/119,679

(22) PCT Filed: Jun. 4, 2009

(86) PCT No.: PCT/JP2009/060240

§ 371 (c)(1),
(2), (4) Date: Mar. 17, 2011

(87) PCT Pub. No.: WO2010/032517

PCT Pub. Date: Mar. 25, 2010

(65) Prior Publication Data

US 2011/0170701 A1 Jul. 14, 2011

(30) Foreign Application Priority Data

Sep. 18, 2008 (JP) ..... 2008-238945

(51) Int. Cl.
*G10K 11/16* (2006.01)
*G10K 11/178* (2006.01)

(52) U.S. Cl.
CPC .... *G10K 11/178* (2013.01); *G10K 2210/12821* (2013.01); *G10K 2210/129* (2013.01)

(58) Field of Classification Search
CPC ..... G10K 11/178; G10K 11/1784; G10K 11/1786; G10K 11/1788; G10K 2210/128; G10K 2210/1282; G10K 2210/12821; G10K 2210/129; G10K 2210/3023; G10K 2210/3046; H04R 1/1083
USPC ..... 381/71.1, 71.3, 71.4, 71.11, 84
See application file for complete search history.

(56) References Cited

U.S. PATENT DOCUMENTS

| | | | | |
|---|---|---|---|---|
| 5,325,437 | A * | 6/1994 | Doi et al. | 381/71.9 |
| 5,384,853 | A * | 1/1995 | Kinoshita et al. | 381/71.12 |
| 5,485,523 | A * | 1/1996 | Tamamura et al. | 381/71.4 |
| 5,687,075 | A * | 11/1997 | Stothers | 700/28 |
| 5,758,311 | A * | 5/1998 | Tsuji et al. | 701/111 |
| 7,352,869 | B2 | 4/2008 | Inoue et al. | |
| 8,027,484 | B2 * | 9/2011 | Yoshida et al. | 381/71.4 |
| 2004/0076302 | A1 * | 4/2004 | Christoph | 381/57 |

(Continued)

FOREIGN PATENT DOCUMENTS

| | | |
|---|---|---|
| EP | 1 855 270 A2 | 11/2007 |
| JP | 05-265471 A | 10/1993 |

(Continued)

*Primary Examiner* — Davetta W Goins
*Assistant Examiner* — Daniel Sellers
(74) *Attorney, Agent, or Firm* — Carrier Blackman & Associates, P.C.; Joseph P. Carrier; Fulchand P. Shende

(57) ABSTRACT

An active noise control device detects composite vibration of a vibration transmitting route to which both vibration of a rotating body caused by generation or transmission of drive force of a vehicle and vibration of a wheel generated by contact between the wheel and a road surface are transmitted. A first reference signal for defining a reference waveform of a canceling sound for canceling vibration noise in a vehicle interior is generated based on the composite vibration. The component of the canceling sound for canceling vibration noise of the rotating body is removed from the first reference signal to generate a second reference signal for defining a reference waveform of the canceling sound for canceling vibration noise of the wheel. The canceling sound is outputted based on the second reference signal.

2 Claims, 7 Drawing Sheets

(56) References Cited

U.S. PATENT DOCUMENTS

2008/0095383 A1* 4/2008 Pan et al. ..... 381/71.11
2009/0279710 A1* 11/2009 Onishi et al. ..... 381/71.4

FOREIGN PATENT DOCUMENTS

JP 06-043881 A 2/1994
JP 06-059688 A 3/1994
JP 06-250672 A 9/1994
JP 07-028474 A 1/1995
JP 07-104767 A 4/1995
JP 07-168578 A 7/1995
JP 10-214119 A 8/1998
JP 2004-361721 A 12/2004
JP 2006-213297 A 8/2006

* cited by examiner

ACTIVE NOISE CONTROL DEVICE

CROSS-REFERENCED TO RELATED APPLICATION

This application is a National Stage entry of International Application No. PCT/JP 2009/060240, filed on Jun. 4, 2009, which claims priority to Japanese Patent Application 2008-238945, filed on Sep. 18, 2008. The disclosure of the prior application is hereby incorporated in its entirety by reference.

TECHNICAL FIELD

The present invention relates to an active noise control apparatus (device) that generates a canceling sound for a vibration noise such as a road noise to reduce the vibration noise.

BACKGROUND ART

An active noise control apparatus (referred to as an "ANC apparatus" hereinafter) is known as an apparatus for controlling sound related to vibration noise in a vehicle interior. The ANC apparatus outputs a canceling sound of a phase opposite to that of the vibration noise from a speaker inside a vehicle interior to reduce the vibration noise. An error between the vibration noise and the canceling sound is detected as a residual noise by a microphone disposed near an ear of a vehicle occupant and is used for determining the canceling sound at a later stage. The ANC apparatus reduces the vibration noise (muffled engine sound) generated in the vehicle interior in accordance with an operation (vibration) or the like of an engine installed in a vehicle, or reduces the vibration noise (road noise) generated in the vehicle interior in accordance with a contact between wheels and a road surface while the vehicle is running. Generating mechanism of the road noise is very complicated, however, a path for the road noise to reach to an ear of a vehicle occupant can be exemplarily illustrated as in FIG. 6.

In order to calculate the canceling sound for the road noise, some of the ANC apparatus that attenuate the road noise employ one or more acceleration sensors provided on a suspension for detecting the vibration of the wheel (Japanese Laid-Open Patent Publication No. 05-265471, Japanese Laid-Open Patent Publication No. 06-059688, Japanese Laid-Open Patent Publication No. 06-250672 and Japanese Laid-Open Patent Publication No. 07-028474). Such ANC apparatus apply adaptive control processing to a base signal based on detected values of the acceleration sensors and outputs the canceling sound in accordance with a control signal generated by the adaptive control processing. In the adaptive control processing, the amplitude of the base signal is adjusted so that an error between the vibration noise and the canceling sound is minimized.

SUMMARY OF INVENTION

When an acceleration sensor is provided on a suspension as disclosed in the above publications, the acceleration sensors detect not only vibrations from a wheel but also vibrations from an engine. Specifically, as shown in FIG. 7, a muffled engine sound is generated also by the vibration reaching a body through a knuckle, lower arm, upper arm and damper spring of the suspension. Thus, when the acceleration sensors are provided on the suspension, the values detected by the acceleration sensors contain the vibration components of the engine as well as the vibration components of the wheel.

Accordingly, the adaptive control processing is performed based on the vibration components of the engine in addition to the vibration components of the wheel. Since there is no interrelationship between the vibration components of the wheel and the engine, noise-canceling performance of the road noise is lowered.

The present invention has been made in view of the above problem. An object of the invention is to provide an active noise control apparatus that can improve noise-canceling performance of a vibration noise.

An active noise control apparatus according to an aspect of the invention includes: a vibration detector that detects a composite vibration in a vibration transmission path in which both a vibration of a rotary body caused on account of generation or transmission of a drive force of a vehicle and a vibration of a wheel generated on account of a contact between the wheel and a road surface are transmitted; a first base signal generator that generates a first base signal that defines a standard waveform of a canceling sound for a vibration noise in a vehicle interior based on the composite vibration detected by the vibration detector; a second base signal generator that removes a component of the canceling sound for a vibration noise of the rotary body from the first base signal to generate a second base signal that defines a standard waveform of the canceling sound for a vibration noise of the wheel; a control signal generator that applies adaptive control processing to the second base signal for reducing an error between the vibration noise in the vehicle interior and the canceling sound to generate a control signal; a canceling sound output unit that outputs the canceling sound based on the control signal; and an error detector that detects a residual noise indicating the error between the vibration noise in the vehicle interior and the canceling sound and outputs an error signal corresponding to the residual noise.

According to the above aspect of the invention, the components of the canceling sound for the vibration noise of the rotary body is removed from the first base signal that is based on the composite vibration including the vibration components of the wheel and the vibration components of the rotary body, to generate the second base signal that defines the standard waveform of the canceling sound for the vibration noise of the wheel. Then, adaptive control processing for reducing the error between the vibration noise in the vehicle interior and the canceling sound is applied to the second base signal to obtain the control signal that is used to output the canceling sound. The components of the canceling sound for the vibration noise of the rotary body is removed from second base signal used in the adaptive control processing. Accordingly, a calculation for reducing the error on account of the vibration noise of the rotary body is not conducted in the adaptive control processing. Thus, the influence of the vibration components of the rotary body contained in the composite vibration can be eliminated from the arithmetic processing of the vibration components of the wheel. Accordingly, the noise-canceling performance of the active vibration control apparatus can be enhanced.

In the above arrangement, the second base signal generator may include: a third base signal generator that generates a third base signal that defines a standard waveform of the canceling sound for the vibration noise of the rotary body; a first adaptive filter that applies adaptive filtering using a first filter coefficient to the third base signal to output a second control signal; a subtractor that subtracts the second control signal from the first base signal to output the second base signal after removing from the first base signal the component of the canceling sound for the vibration noise of the rotary body; a delay unit that delays the second base signal; and a first filter coefficient updating unit that sequentially updates the first filter coefficient so that the second base signal is minimized. With the above arrangement, the components of the canceling sound for the vibration noise of the rotary body can be further accurately removed from the first base signal.

In the above arrangement, the control signal generator may include: a second adaptive filter that applies adaptive filtering to the second base signal using a second filter coefficient to output the control signal; a reference signal generator that corrects the second base signal based on a transmission characteristic from the canceling sound output unit to the error detector to generate a reference signal; and a filter coefficient updating unit that sequentially updates the second filter coefficient based on the reference signal and the error signal so that the error signal is minimized. According to the above arrangement, the error between the vibration noise in the vehicle interior and the canceling sound can be further accurately reduced.

DESCRIPTION OF EMBODIMENTS

A. Exemplary Embodiment

An exemplary embodiment of the invention will be described below with reference to attached drawings.

1. Entire and Partial Arrangements (1) Entire Arrangement

Figure 1:
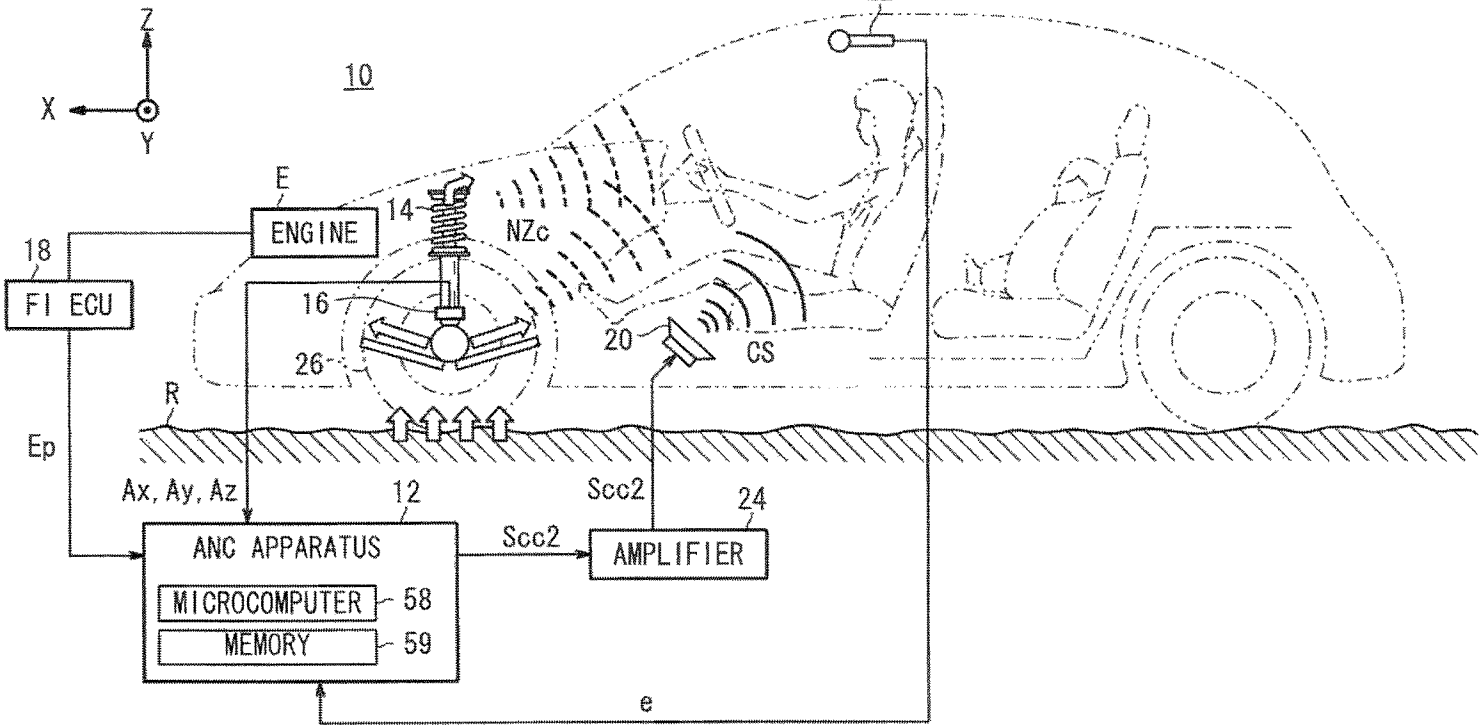
FIG. 1 is an illustration schematically showing a vehicle in which an active noise control apparatus according to an exemplary embodiment of the invention is installed.

FIG. 1 is an illustration schematically showing a vehicle 10 in which an active noise control apparatus 12 (referred to as an "ANC apparatus 12" hereinafter) according to the exemplary embodiment of the invention is installed. The vehicle 10 may be a gasoline vehicle, an electric vehicle, a fuel cell vehicle and the like.

The ANC apparatus 12 is connected to: a plurality of acceleration sensor units 16 provided on a suspension 14; a fuel injection control unit 18 (hereinafter referred to as an "FI ECU (Fuel Injection Electronic Control Unit) 18" for controlling a fuel injection of an engine E; a speaker 20; and a microphone 22. An amplifier 24 is interposed between the ANC apparatus 12 and the speaker 20. The ANC apparatus 12 generates a second composite control signal Scc2 based on vibration accelerations Ax, Ay, Az [mm/s/s] in three orthogonal axes detected by the acceleration sensor units 16, engine pulses Ep from the FI ECU 18 and an error signal e outputted by the microphone 22. The second composite control signal Scc2 is outputted to the speaker 20 after being amplified by the amplifier 24. The speaker 20 outputs a canceling sound CS corresponding to the second composite control signal Scc2.

The vibration noise generated in the vehicle interior of the vehicle 10 is a noise (composite noise NZc) combining the vibration noise generated in accordance with the vibration of the engine E (muffled engine sound NZe) and the vibration noise (road noise NZr) generated in accordance with the vibration of the wheel 26 caused when the wheel 26 contacts a road surface R while the vehicle 10 is running. According to the ANC apparatus 12 of this exemplary embodiment, the canceling sound CS cancels the components of the road noise NZr in the composite noise NZc to obtain a noise-canceling effect.

Incidentally, the ANC apparatus 12 may be designed to cancel the muffled engine sound NZe in addition to the road noise NZr. In other words, the ANC apparatus 12 may be additionally provided with a typical arrangement for the muffled engine sound (such as one disclosed in Japanese Laid-Open Patent Publication No. 2004-361721).

Figure 3:
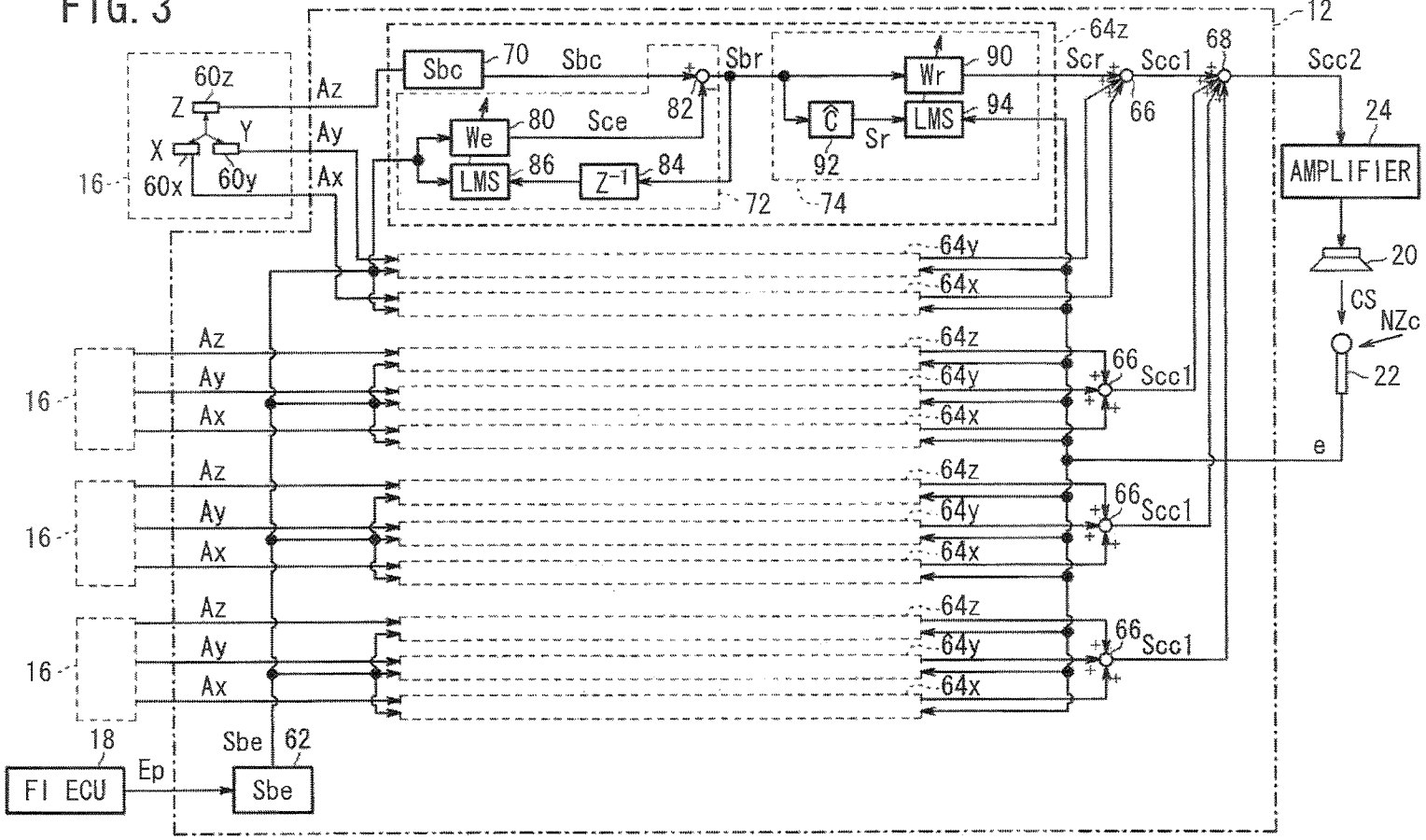
FIG. 3 is a block diagram showing in a circuit configuration general functions of the active noise control apparatus implemented by software.

Further, though not shown in FIG. 1, the acceleration sensor unit 16 includes four sensor units (see FIG. 3), which are respectively provided corresponding to four wheels 26 (left front wheel, right front wheel, left rear wheel and right rear wheel). Further, though only one speaker 20 and one microphone 22 are illustrated in FIGS. 1 and 3 for facilitating the understanding of the invention, a plurality of speakers 20 and a plurality of microphones 22 may be used in accordance with the usage of the ANC apparatus 12. In this case, the number of the other components is also altered as necessary.

(2) Suspension 14 and Acceleration Sensor Unit 16

Figure 2:
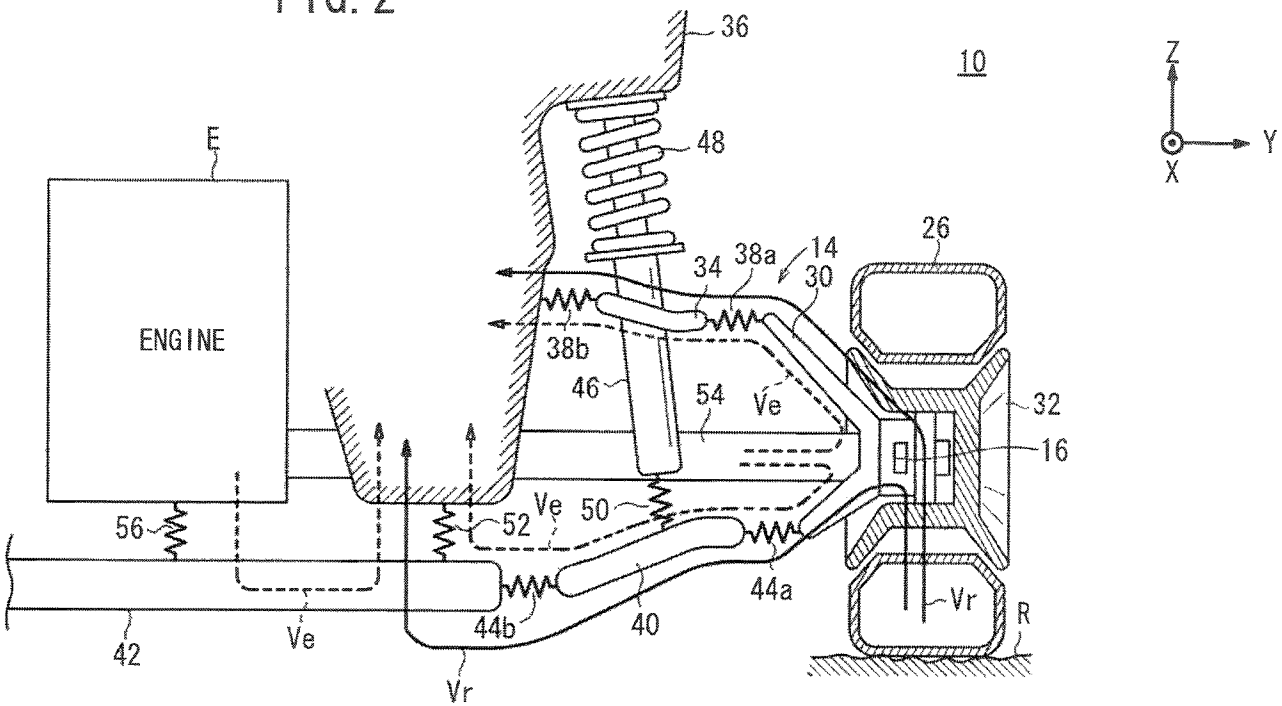
FIG. 2 illustrates an attachment position of an acceleration sensor unit provided in the vehicle and a transmission path of vibrations from an engine and from a wheel.

As shown in FIG. 2, each of the acceleration sensor units 16 is provided on a knuckle 30 of the suspension 14 connected to a wheel unit 32 of the wheel 26. In addition to the knuckle 30, the suspension 14 includes: an upper arm 34 connected to the knuckle 30 and a body 36 via connectors 38*a* and 38*b*; a lower arm 40 connected to the knuckle 30 and a sub frame 42 via connectors 44*a*, 44*b*; and a damper 46 connected to the body 36 via a damper spring 48 and connected to the lower arm 40 via a connector 50. The body 36 and the sub frame 42 are connected via a connector 52. A drive shaft 54 extending from the engine E is rotatably inserted into the knuckle 30. The engine E and the sub frame 42 are connected via a connector 56.

As shown in FIG. 3, each of the acceleration sensor units 16 includes three acceleration sensors 60*x*, 60*y*, 60*z* respectively for detecting vibration accelerations Ax, Ay, Az of the knuckle 30. The vibration acceleration Ax detected by the acceleration sensor 60*x* represents the vibration acceleration [mm/s/s] of the knuckle 30 in front-back direction (X-direction in FIG. 1). The vibration acceleration Ay detected by the acceleration sensor 60*y* represents the vibration acceleration [mm/s/s] of the knuckle 30 in right-left direction (Y-direction in FIG. 2). The vibration acceleration Az detected by the acceleration sensor 60*z* represents the vibration acceleration [mm/s/s] of the knuckle 30 in up-down direction (Z-direction in FIG. 1).

The respective acceleration sensor units 16 transmit the vibration accelerations Ax, Ay, Az (the signals representing the accelerations) detected on the respective knuckles 30 to the ANC apparatus 12.

(3) FI ECU 18

The FI ECU 18 controls the fuel injection and ignition of the engine E and transmits the engine pulses Ep in accordance with the ignition to the ANC apparatus 12.

(4) ANC Apparatus 12

(a) Entire Arrangement

The ANC apparatus 12 controls the output of the canceling sound CS from the speaker 20. The ANC apparatus 12 includes a microcomputer 58, a memory 59 (FIG. 1), non-illustrated input and output circuits and the like. The microcomputer 58 is adapted to execute a function to determine the canceling sound CS (canceling sound determining function) and the like by software.

FIG. 3 is a block diagram showing in a circuit configuration general functions of the microcomputer 58 implemented by software.

As described above, the vehicle 10 has the acceleration sensor units 16 corresponding to the four wheels 26. Each of the acceleration sensor units 16 includes the acceleration sensor 60*x* for detecting the vibration acceleration Ax, the acceleration sensor 60*y* for detecting the vibration acceleration Ay and the acceleration sensor 60*z* for detecting the vibration acceleration Az. The vibration accelerations Ax, Ay, Az detected by the acceleration sensor units 16 are outputted to the ANC apparatus 12. Further, the engine pulses Ep from the FI FCU 18 are also outputted to the ANC apparatus 12.

The ANC apparatus 12 includes: a base signal generator 62 for the muffled engine sound NZe; signal controllers 64*x*, 64*y*, 64*z* provided on each of the acceleration sensor units 16; a first adder 66; and a second adder 68. The signal controller 64*x* is provided to each of the acceleration sensors 60*x*, the signal controller 64*y* is provided to each of the acceleration sensors 60*y* and the signal controller 64*z* is provided to each of the acceleration sensors 60*z*. All of the signal controllers 64*x*, 64*y*, 64*z* have similar arrangement.

Incidentally, an inner arrangement of the uppermost one of the plurality of signal controllers 64*x*, 64*y*, 64*z* (the signal controller 64*z*) is described in detail in FIG. 3 and inner arrangements of the other signal controllers 64*x*, 64*y*, 64*z* are not illustrated.

(b) Base Signal Generator 62 for Muffled Engine Sound NZe

The base signal generator 62 generates a muffled engine sound base signal Sbe (sometimes referred to as "base signal Sbe" hereinafter) based on the engine pulses Ep. The engine pulses Ep are equal to the combustion cycle in the engine E. The combustion cycle is equal to a rotation period [s] of the engine E. In other words, the frequency [Hz] of the engine pulses Ep is equal to the vibration frequency of the engine E. As a result, the frequency of the engine pulses Ep interrelates to the frequency of the vibration noise (muffled engine sound NZe) originated from the engine E.

Since the base signal Sbe is generated in accordance with the engine pulses Ep, the frequency of the base signal Sbe is equal to respective order components (e.g. second, fourth, sixth, eighth . . . orders in case of a four-cylinder engine) of the frequency of the engine pulses Ep. In other words, the frequency [Hz] of the base signal Sbe is equal to the order components of the rotation frequency [Hz] of the engine E. Accordingly, the base signal Sbe interrelates to the frequency of the muffled engine sound NZe.

(c) Signal Controllers 64*x*, 64*y*, 64*z*

Each of the signal controllers 64*x*, 64*y*, 64*z* has a base signal generator 70 for the composite noise NZc, a base signal generator 72 for the road noise NZr and a control signal generator 74.

(i) Base Signal Generator 70

The base signal generator 70 generates a composite noise base signal Sbc (also referred to as "base signal Sbc" hereinafter) that represents a standard waveform of the canceling sound CS for the composite noise NZc based on the vibration acceleration Ax, Ay, Az detected by the acceleration sensors 60*x*, 60*y*, 60*z*.

As shown in FIG. 2, the vibration (engine vibration Ve) generated in accordance with the actuation of the engine E is transmitted to the knuckle 30 in addition to the vibration (wheel vibration Vr) caused on the wheel 26 when the wheel 26 contacts the road surface R. Accordingly, the vibration accelerations Ax, Ay, Az show the acceleration [mm/s/s] of the vibration (composite vibration Vc) of the combination of the wheel vibration Vr and the engine vibration Ve. The acceleration [mm/s/s] of the wheel vibration Vr interrelates to a frequency [Hz] of the road noise NZr. The acceleration [mm/s/s] of the engine vibration Ve interrelates to a frequency [Hz] of the muffled engine sound NZe. Thus, the acceleration of the composite vibration Vc interrelates to the frequencies of the road noise NZr and the muffled engine sound NZe. Hence, the vibration accelerations Ax, Ay, Az representing the components of accelerations of the composite vibration Vc in respective axis directions interrelate to the respective frequencies of the road noise NZr and the muffled engine sound NZe. However, as described below, the road noise NZr cannot be sufficiently canceled when the composite noise NZc is to be directly canceled.

(ii) Base Signal Generator 72 for Road Noise NZr

The base signal generator 72 removes the components of the canceling sound CS for the muffled engine sound NZe from the base signal Sbc generated by the base signal generator 70 to extract the components of the canceling sound CS for the road noise NZr, and then to generate a base signal Sbr representing the standard waveform of the canceling sound CS for the road noise NZr. The base signal generator 72 includes a filter 80, a subtractor 82, a delay unit 84 and a filter coefficient updating unit 86.

The filter 80 is a notch filter that filters the base signal Sbe from the base signal generator 62 using a filter coefficient We to output a control signal Sce that defines the waveform of the canceling sound CS for the muffled engine sound NZe. As described above, since the base signal Sbe interrelates to the frequency of the muffled engine sound NZe, the control signal Sce based on the base signal Sbe interrelates to the frequency of the muffled engine sound NZe.

The subtractor 82 subtracts the control signal Sce from the base signal Sbc generated by the base signal generator 70 to generate the road noise base signal Sbr (referred to as the "base signal Sbr" hereinafter) based on the difference therebetween (Sbc−Sce). Though the composite noise base signal Sbc contained the components of the road noise NZr and the muffled engine sound NZe, since the control signal Sce representing the components of the canceling sound CS for the muffled engine sound NZe has been subtracted, the road noise base signal Sbr contains only the components of the canceling sound CS for the road noise NZr. The base signal Sbr is outputted to the control signal generator 74 and the delay unit 84.

After the delay unit 84 delays the base signal Sbr by one calculation cycle, the delay unit 84 outputs the base signal Sbr to the filter coefficient updating unit 86.

The filter coefficient updating unit 86 sequentially calculates and updates the filter coefficient We. The filter coefficient updating unit 86 calculates the filter coefficient We using an adaptive algorithm [e.g. least square method (LMS) algorithm]. Specifically, the filter coefficient updating unit 86 calculates the filter coefficient We so that respective order components of engine speed frequency [Hz] contained in the base signal Sbr is minimized based on the muffled engine sound base signal Sbe from the base signal generator 62 and the road noise base signal Sbr from the subtractor 82.

(iii) Control Signal Generator 74

The control signal generator 74 applies adaptive filtering to the road noise base signal Sbr to generate a control signal Scr. The control signal generator 74 includes an adaptive filter 90, a reference signal generator 92 and a filter coefficient updating unit 94.

The adaptive filter 90 is an FIR (Finite impulse response) filter that applies adaptive filtering to the base signal Sbr using the filter coefficient Wr to output the control signal Scr that represents the waveform of the canceling sound CS for reducing the road noise NZr.

The reference signal generator 92 applies transfer function processing to the base signal Sbr outputted by the base signal generator 72 to generate a reference signal Sr. The reference signal Sr is used for calculating the filter coefficient Wr by the filter coefficient updating unit 94. The transfer function processing wave-filters the base signal Sbr based on the transfer function (filter coefficient) of the canceling sound CS from the speaker 20 to the microphone 22. The transfer function used in the transfer function processing is a measurement value or a predicted value of an actual transfer function C of the canceling sound CS from the speaker 20 to the microphone 22.

The filter coefficient updating unit 94 sequentially calculates and updates the filter coefficient Wr. The filter coefficient updating unit 94 calculates the filter coefficient Wr using an adaptive algorithm [e.g. least square method (LMS) algorithm]. Specifically, the filter coefficient updating unit 94 calculates the filter coefficient Wr based on the reference signal Sr from the reference signal generator 92 and an error signal e from the microphone 22 so that square (e2) of the error signal e becomes zero.

(d) First Adder 66

Respective one of the first adders 66 synthesizes the control signals Scr outputted by the three signal controllers 64*x*, 64*y*, 64*z* corresponding to the respective acceleration sensor units 16 to generate a first composite control signal Scc1.

(e) Second Adder 68

The second adder 68 synthesizes the first composite control signals Scc1 outputted by the respective first adders 66 to generate the second composite control signal Scc2. The second composite control signal Scc2 is outputted to the speaker 20 after being amplified by the amplifier 24.

(5) Speaker 20

The speaker 20 outputs the canceling sound CS corresponding to the second composite control signal Scc2 from the ANC apparatus 12 (microcomputer 58). Thus, the components of the road noise NZr in the composite noise NZc can be canceled.

(6) Microphone 22

The microphone 22 detects an error between the composite noise NZc containing the components of the road noise NZr and the canceling sound CS as a residual noise and outputs the error signal e representing the residual noise to the ANC apparatus 12 (microcomputer 58).

2. Generation of Canceling Sound CS

Figure 4:
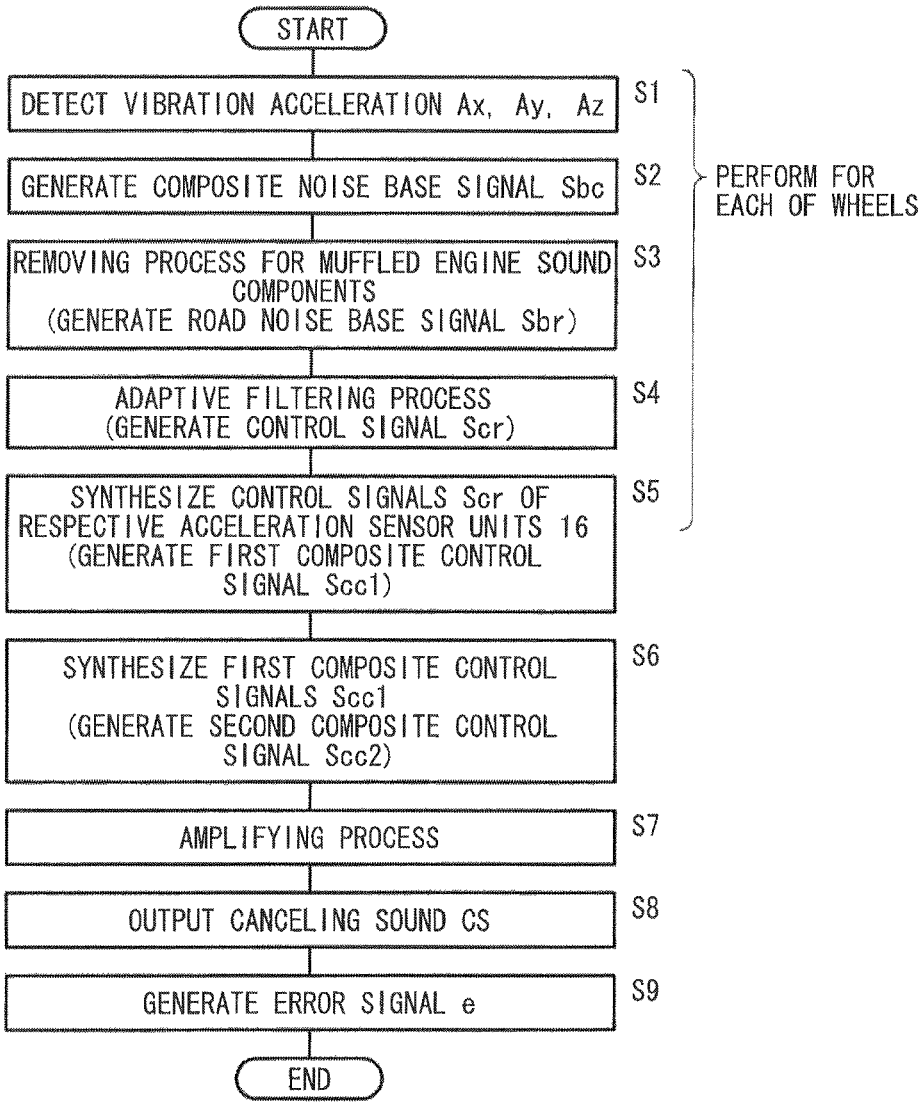
FIG. 4 is a flowchart for generating a canceling sound in the exemplary embodiment.

Next, a flow for generating the canceling sound CS in this exemplary embodiment will be described below. FIG. 4 is a flowchart for generating the canceling sound CS.

In step S1, the acceleration sensors 60*x*, 60*y*, 60*z* of the respective acceleration sensor units 16 detect the vibration acceleration Ax in X-axis direction, the vibration acceleration Ay in Y-axis direction and the vibration acceleration Az in Z-axis direction. The vibration accelerations Ax, Ay, Az contain both the components of the vibration Vr of the wheel 26 (i.e., the components of the road noise NZr) and the components of the vibration Ve of the engine E (i.e., the components of the muffled engine sound NZe).

In step S2, the base signal generator 70 outputs the composite noise base signal Sbc based on the detected vibration accelerations Ax, Ay, Az.

In step S3, the respective base signal generators 72 output the road noise base signal Sbr corresponding to the difference between the composite noise base signal Sbc outputted by the base signal generator 70 and the control signal Sce outputted by the filter 80 (muffled engine sound components removing process). As described above, since the control signal Sce is set to be equal to the components of the canceling sound CS for the muffled engine sound NZe contained in the base signal Sbc, the base signal Sbr contains only the components of the canceling sound CS for the road noise NZr.

In step S4, the respective control signal generators 74 generate the control signal Scr by applying the adaptive filtering to the base signal Sbr based on the base signal Sbr outputted by the base signal generator 72 and the error signal e outputted by the microphone 22.

In step S5, the first adders 66 synthesize the control signal Scr outputted from the three control signal generators 74 corresponding to the respective acceleration sensor units 16 to generate the first composite control signal Scc1.

The ANC apparatus 12 performs the above steps S1 to S5 for each of the four wheels 26 (i.e., for the acceleration sensor units 16).

In step S6, the second adder 68 synthesizes the first composite control signals Scc1 outputted by the respective first adders 66 to generate the second composite control signal Scc2. In step S7, the amplifier 24 amplifies the second composite control signal Scc2 at a predetermined amplification factor. In step S8, the speaker 20 outputs the canceling sound CS based on the amplified second composite control signal Scc2.

In step S9, the microphone 22 detects the difference between the composite noise NZc containing the road noise NZr and the canceling sound CS, and outputs the error signal e corresponding to the residual noise. The error signal e is used in the subsequent processing of the respective control signal generators 74.

The ANC apparatus 12 repeats the above steps S1 to S9.

3. Advantages of the Exemplary Embodiment

As described above, according to this exemplary embodiment, the components corresponding to the vibration Ve of the engine E (i.e. the components of the canceling sound CS for the muffled engine sound NZe) are removed from the composite vibration base signal Sbc based on the composite vibration Vc including the components of the vibration Vr of the wheel 26 and the vibration Ve of the engine E to generate the road noise base signal Sbr that defines the standard waveform of the canceling sound CS for the road noise NZr. Further, the adaptive control processing for minimizing the error (square (e2) of the error signal e) between the composite noise NZc containing the road noise NZr and the canceling sound CS is applied on the base signal Sbr to obtain the control signal Scr, which is used for outputting the canceling sound CS. The components of the canceling sound CS for the muffled engine sound NZe has been removed from the base signal Sbr used in the adaptive control processing. Accordingly, no calculation for reducing the error caused by the muffled engine sound NZe is conducted in the adaptive control processing. Thus, the influence of the components of the vibration Ve of the engine E contained in the composite vibration VC can be eliminated from the arithmetic processing of the components of the vibration Vr of the wheel 26. Accordingly, the noise-canceling performance of the ANC apparatus 12 can be enhanced.

Figure 5A:
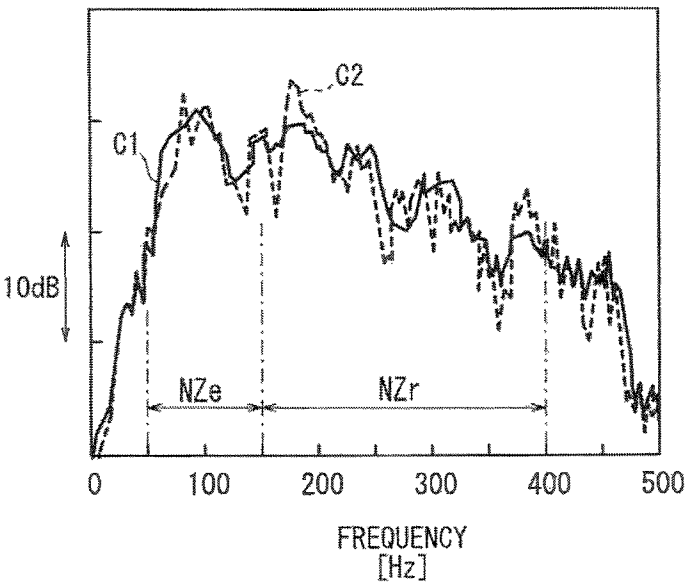
FIG. 5A is a graph showing sound pressure level characteristics in a vehicle interior when the active noise control apparatus is actuated without removing muffled engine sound component, and sound pressure level characteristics in the vehicle interior when the active noise control apparatus is not actuated.
Figure 5B:
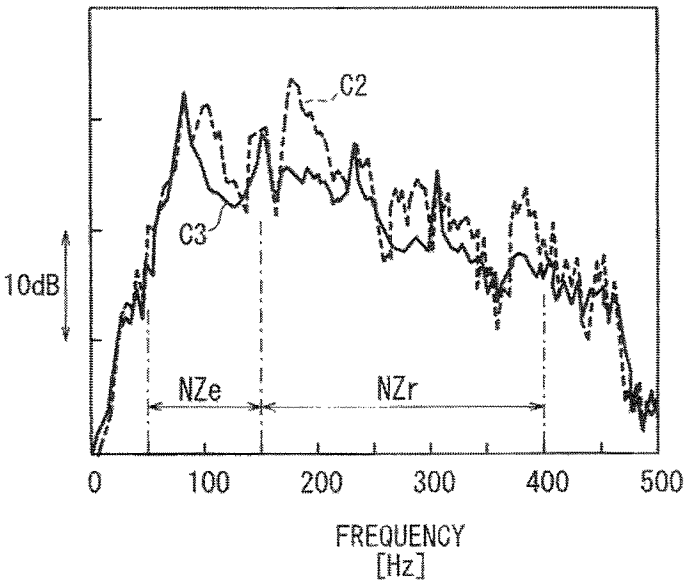
FIG. 5B is a graph showing sound pressure level characteristics in a vehicle interior when the active noise control apparatus is actuated while removing muffled engine sound component, and sound pressure level characteristics in the vehicle interior when the active noise control apparatus is not actuated.
Figure 6:
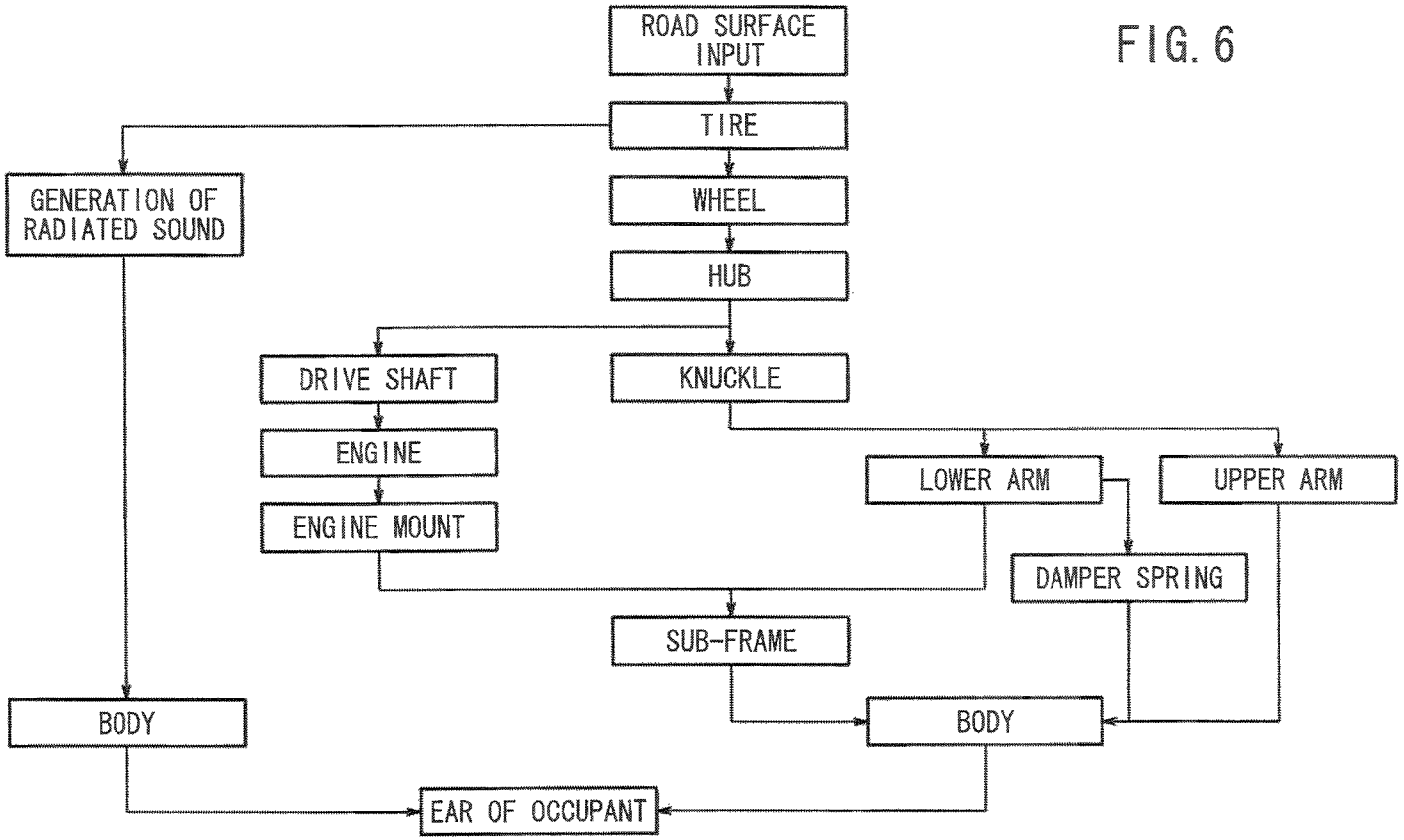
FIG. 6 illustrates a generation mechanism of a road noise.
Figure 7:
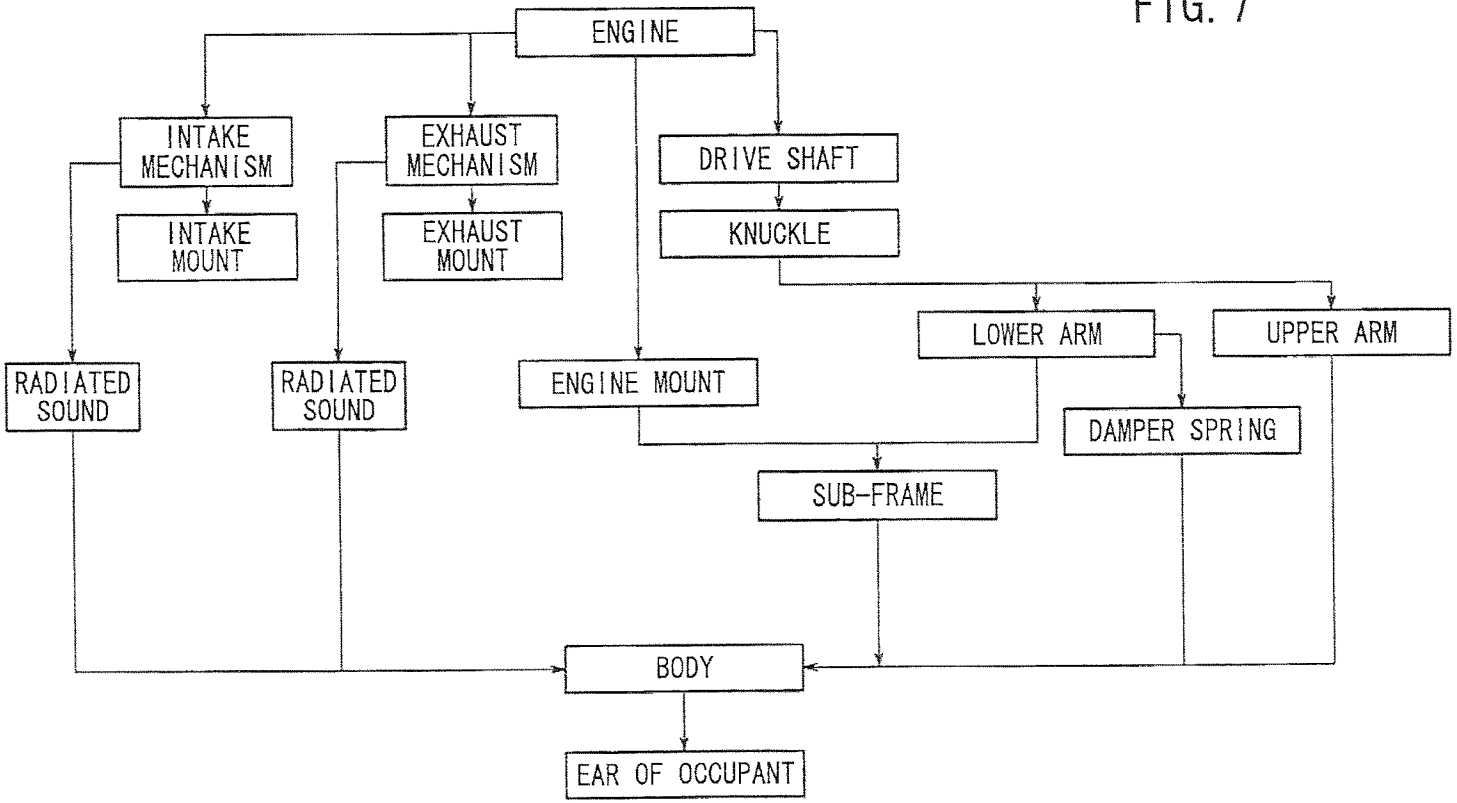
FIG. 7 illustrates a generation mechanism of a muffled engine sound.

FIG. 5A shows sound pressure level characteristics C1 (shown in a solid line in FIG. 5A) of the composite noise NZc when the ANC apparatus 12 is actuated without removing the muffled engine sound in the base signal generator 72 and sound pressure level characteristics C2 (shown in a dashed line in FIG. 5A) of the composite noise NZc without actuating the ANC apparatus 12. FIG. 5B shows sound pressure level characteristics C3 (shown in a solid line in FIG. 5B) of the composite noise NZc when the ANC apparatus 12 is actuated while removing the muffled engine sound and the same sound pressure level characteristics C2 (shown in a dashed line in FIG. 5B) as in FIG. 5A.

In FIG. 5A, though the sound pressure level characteristics C1 exhibit a certain noise-canceling effect at a peak value (around 180 Hz) of the components of the road noise NZr (150-400 Hz) as compared to the sound pressure level characteristics C2, no significant noise-canceling effect is obtained including the components of the muffled engine sound NZe (50-150 Hz).

In contrast, in FIG. 5B, though the sound pressure level characteristics C3 do not exhibit a noise-canceling effect for the components of the muffled engine sound NZe (50-150 Hz), the sound pressure level characteristics C3 generally exhibit eminent noise-canceling effect over the components of the road noise NZr (150-400 Hz) as compared with the sound pressure level characteristics C2.

The base signal generator 72 includes: the base signal generator 62 for generating the muffled engine sound base signal Sbe that defines the standard waveform of the canceling sound CS for the muffled engine sound NZe; the filter 80 for applying the adaptive filtering to the base signal Sbe using the filter coefficient We for outputting the control signal Sce; the subtractor 82 that subtracts the control signal Sce from the composite noise base signal Sbc for removing the components of the canceling sound CS for the muffled engine sound NZe from the base signal Sbc to output the road noise base signal Sbr; the delay unit 84 for delaying the base signal Sbr; and the filter coefficient updating unit 86 that sequentially updates the filter coefficient We so that the respective order components of the engine speed frequency in the base signal Sbr are minimized. Thus, the components of the canceling sound CS for the muffled engine sound NZe can be further accurately removed from the composite vibration base signal Sbc.

In this exemplary embodiment, the respective control signal generators 74 include: the adaptive filter 90 that applies the adaptive filtering to the road noise base signal Sbr using the filter coefficient Wr for outputting the control signal Scr; the reference signal generator 92 that corrects the road noise base signal Sbr based on the transmission characteristics $\hat{C}$ to generate the reference signal Sr; and the filter coefficient updating unit 94 that sequentially updates the filter coefficient Wr based on the reference signal Sr and the error signal e so that the square e2 of the error signal is minimized. Thus, the components of the road noise NZr in the error between the canceling sound CS and the composite noise NZc containing the road noise NZr can be more accurately reduced.

B. Modifications of the Invention

It should be understood that the present invention can be embodied not only as in the above exemplary embodiment but also in various arrangement according to the disclosure of the present description. Examples of the arrangements are as follows.

Though the acceleration sensor unit 16 is provided on each of the four wheels 26, the acceleration sensor unit 16 may be provided only one or some of the wheels 26. Though the acceleration sensor units 16 respectively detect the vibration accelerations Ax, Ay, Az of the vibrations in three axis-directions (i.e. X-axis direction, Y-axis direction and Z-axis direction), the acceleration sensor unit 16 may be arranged to detect the vibration in one, two or four or more axis-directions.

Though the vibration accelerations Ax, Ay, Az are directly detected by the acceleration sensors 60*a*, 60*b*, 60*c* in the above exemplary embodiment, the displacement [mm] of the knuckle 30 may be detected by a displacement sensor and the vibration accelerations Ax, Ay, Az may be calculated based on the displacement. Similarly, the vibration accelerations Ax, Ay, Az may be calculated using detection values of a load sensor.

Though the acceleration sensor units 16 are respectively provided on the knuckle 30, the acceleration sensor units 16 may be provided on the other part such as a hub.

Though the composite vibration Vc composed of the vibration Vr of the wheel 26 and the vibration Ve of the engine E is detected by the acceleration sensor unit 16 in the above exemplary embodiment, the composite vibration Vc detected by the acceleration sensor units 16 may include a vibration of a drive shaft in addition to or in place of the vibration Ve of the engine E.

The invention claimed is:

1. An active noise control apparatus, comprising:

a vibration detector that detects a composite vibration in a vibration transmission path in which both a vibration of a rotary body caused on account of generation or transmission of a drive force of a vehicle and a vibration of a wheel generated on account of a contact between the wheel and a road surface are transmitted;

a first base signal generator that generates a first base signal that defines a standard waveform of a canceling sound for a vibration noise in a vehicle interior based on the composite vibration detected by the vibration detector;

a second base signal generator that removes a component of the canceling sound for a vibration noise of the rotary body from the first base signal to generate a second base signal that defines a standard waveform of the canceling sound for a vibration noise of the wheel;

a control signal generator that applies adaptive control processing to the second base signal for reducing an error between the vibration noise in the vehicle interior and the canceling sound to generate a control signal;

a canceling sound output unit that outputs the canceling sound based on the control signal; and an error detector that detects a residual noise indicating the error between the vibration noise in the vehicle interior and the canceling sound and outputs an error signal corresponding to the residual noise, wherein the second base signal generator includes:

a third base signal generator that generates a third base signal based on a detected value of a rotational position of the rotary body, the third base signal having a frequency correlated with a frequency of the vibration noise of the rotary body and defines a standard waveform of the canceling sound for the vibration noise of the rotary body;

a first adaptive filter that applies adaptive filtering using a first filter coefficient to the third base signal to output a second control signal;

a subtractor that subtracts the second control signal from the first base signal to output the second base signal after removing from the first base signal the component of the canceling sound for the vibration noise of the rotary body;

a delay unit that delays the second base signal; and a first filter coefficient updating unit that sequentially updates the first filter coefficient so that the second base signal is minimized.

2. The active noise control apparatus according to claim 1, wherein the control signal generator includes:

a second adaptive filter that applies adaptive filtering to the second base signal using a second filter coefficient to output the control signal;

a reference signal generator that corrects the second base signal based on a transmission characteristic from the canceling sound output unit to the error detector to generate a reference signal; and a filter coefficient updating unit that sequentially updates the second filter coefficient based on the reference signal and the error signal so that the error signal is minimized.

* * * * *